US007841118B2

(12) United States Patent
VanVlymen

(10) Patent No.: US 7,841,118 B2
(45) Date of Patent: Nov. 30, 2010

(54) TRAINING BOLT FOR RIFLE

(76) Inventor: Shayle VanVlymen, 113 W. Water St., Pendleton, IN (US) 46064

( * ) Notice: Subject to any disclaimer, the term of this patent is extended or adjusted under 35 U.S.C. 154(b) by 0 days.

(21) Appl. No.: 12/231,247

(22) Filed: Aug. 28, 2008

(65) Prior Publication Data

US 2009/0260269 A1 Oct. 22, 2009

Related U.S. Application Data

(60) Provisional application No. 61/125,112, filed on Apr. 22, 2008.

(51) Int. Cl.
*F41A 17/00* (2006.01)

(52) U.S. Cl. ..... 42/70.08; 42/70.11

(58) Field of Classification Search ..... 42/70.08, 42/70.11

See application file for complete search history.

(56) References Cited

U.S. PATENT DOCUMENTS 4,079,525 A * 3/1978 Linton et al. ..... 434/18
4,955,812 A * 9/1990 Hill ..... 434/16
5,857,854 A * 1/1999 Kwalwasser ..... 434/18
6,226,914 B1 * 5/2001 Reed ..... 42/70.11
6,240,670 B1 * 6/2001 Findlay ..... 42/70.08
6,470,615 B1 * 10/2002 Peterken ..... 42/70.01
6,931,978 B1 * 8/2005 Dionne ..... 89/194
7,155,856 B1 * 1/2007 Hylenski ..... 42/70.08
7,581,954 B2 * 9/2009 Schavone ..... 434/18
2003/0022135 A1 * 1/2003 Shechter et al. ..... 434/16
2003/0177896 A1 * 9/2003 Dionne ..... 89/33.2

* cited by examiner

*Primary Examiner*—Troy Chambers
*Assistant Examiner*—Samir Abdosh
(74) *Attorney, Agent, or Firm*—Robert D. Varitz, PC

(57) ABSTRACT

A training bolt for use in an automatic or semi-automatic firearm includes a training bolt installable in a bolt receiver of a firearm, wherein the training bolt is constructed and arranged with cutouts and protrusions which cooperate with the internal structure of the firearm bolt receiver and which allow function of the hammer/trigger/safety mechanism of the firearm, wherein the training bolt is configured to prevent, absolutely, chambering or firing a live round.

2 Claims, 2 Drawing Sheets

TRAINING BOLT FOR RIFLE

RELATED APPLICATION

This Application is related to U.S. Provisional Patent Application Ser. No. 61/125,112, filed Apr. 22, 2008 for Replacement Rifle Training Bolt Carrier Group, the entire contents of which is incorporated herein by reference and from which, priority is claimed.

FIELD OF THE INVENTION

This invention is related to firearms, and specifically to a bolt used to replaced an active, firing bolt, which replacement bolt allows rifle training while preventing accidental firing of live ammunition.

BACKGROUND OF THE INVENTION

Any person contemplating the use of a firearm should reasonably undergo some form of training. Such training must necessarily involve use of a weapon in a "safe" condition, i.e., a condition wherein the firearm is not capable of tiring, accidentally or intentionally, live ammunition. The easiest solution is to use an actual firearm, while making sure that live ammunition is not present in the weapon. Experience has shown that such a solution does not always work: sooner or later, a live round of ammunition makes its way into the proverbial "unloaded gun." Additionally, dry tiring, i.e., allowing a firing pin to fall on an empty chamber, of a firearm may be harmful to the firearm. So-called "dummy" ammunition may be provided, which has a cushioning material in place of the convention primer, the use of which lessens the probability of damage to a firing mechanism, however, such dry firing still allows a possibility of accidental chambering of a live round, and only slightly lessens potential damage to a firearm.

Training weapons are available, which weapons are incapable of firing live ammunition. Such inert training weapons, which may be made of polymer or aluminum, are currently on the market, however, such training weapons typically cost hundreds of dollars and require extra space for storage, transportation and shipping.

SUMMARY OF THE INVENTION

A training bolt for use in an automatic or semi-automatic firearm includes a training bolt installable in a bolt receiver of a firearm, wherein the training bolt is constructed and arranged with cutouts and protrusions which cooperate with the internal structure of the firearm bolt receiver and which allow function of the hammer/trigger/safety mechanism of the firearm, wherein the training bolt is configured to prevent, absolutely, chambering or firing a live round. The training bolt is part of a training bolt carrier group, wherein the training bolt carrier group includes an elastic instrumentality to provide simulated operation of the training bolt, and includes appropriate indicia to alert a user that the firearm is equipped with a non-operable, training bolt.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENTS

The present invention is a training bolt for an automatic or semi-automatic firearm. The training bolt is part of a replacement bolt carrier group for a firearm, which allows safe training with an otherwise unmodified rifle or carbine. The replacement bolt carrier group does not allow chambering or detonation of live ammunition.

The invention is described in connections with drawings which represent a training bolt suitable for use in a firearm such as an AR-15 or M16 rifle. It will be understood that the elements and features of the invention are applicable and incorporatable into a training bolt of any automatic or semi-automatic firearm.

Figure 1:
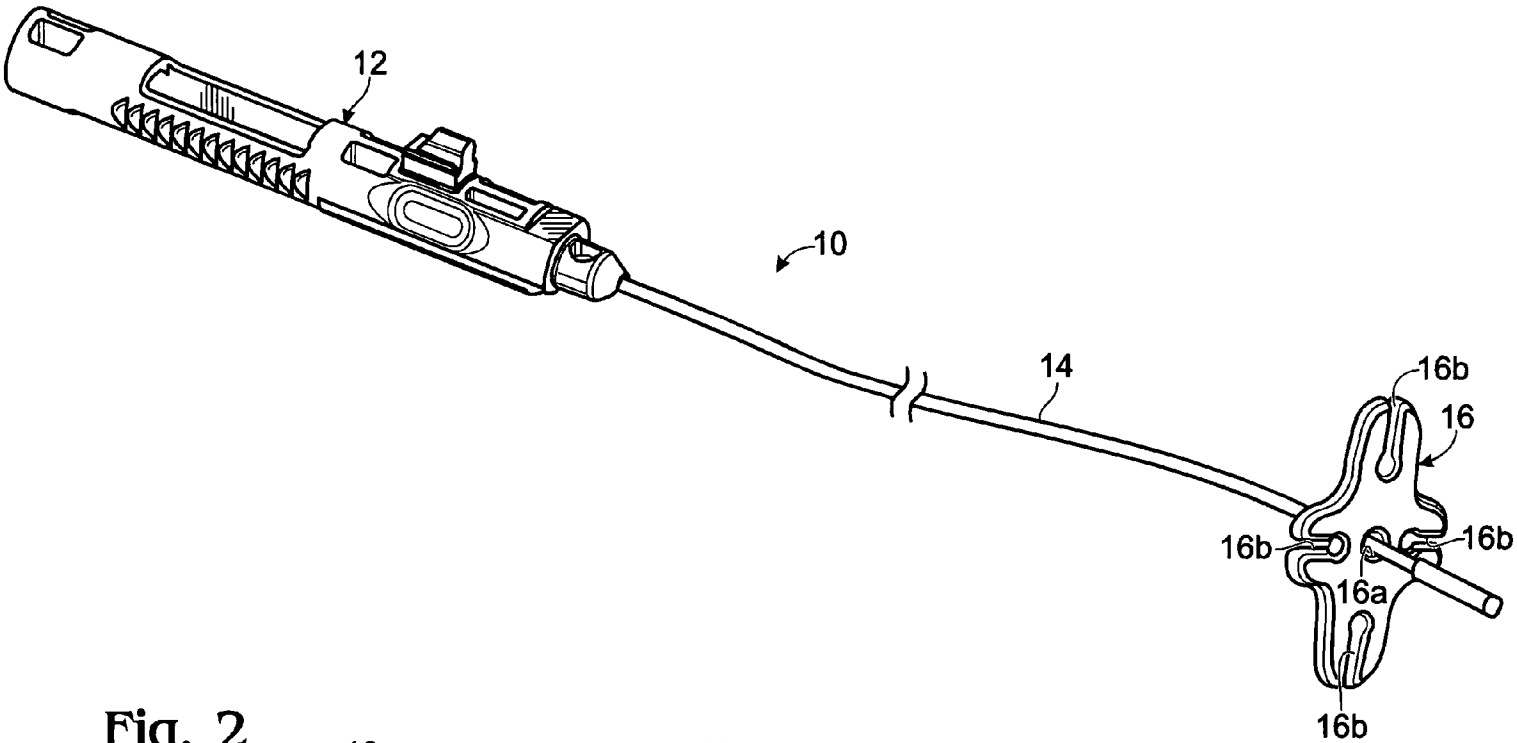
FIG. 1 is an isometric view of a replacement bolt carrier group, with a bungee and warning flag attached thereto, constructed according to the invention, and including, in block diagram form, a firearm having a hammer/trigger/safety mechanism which receives the replacement bolt carrier group.
Figure 2:
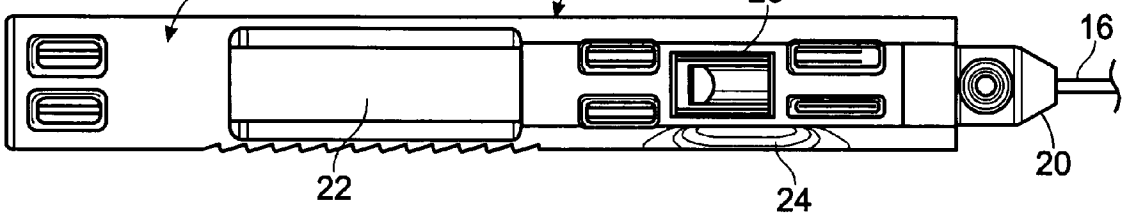
FIG. 2 is a top plan view of a training bolt of the invention.
Figure 3:
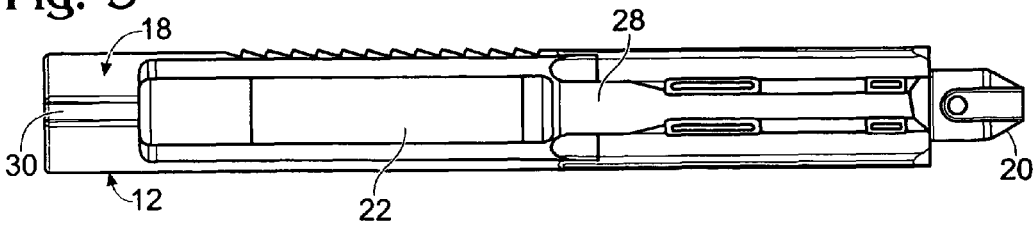
FIG. 3 is a bottom plan view of the training bolt.
Figure 4:
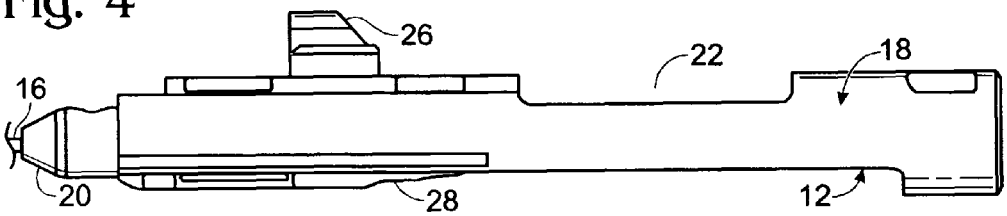
FIG. 4 is a right side elevation of the training bolt.
Figure 5:
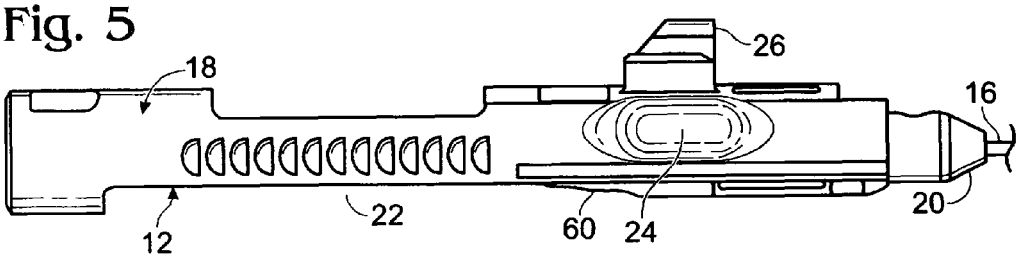
FIG. 5 is a left side elevation of a the training bolt.
Figure 6:
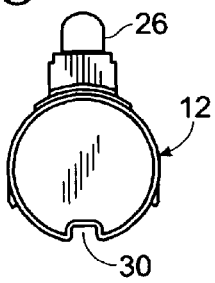
FIG. 6 is a front elevation of the training bolt.
Figure 7:
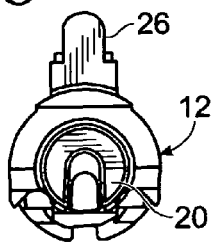
FIG. 7 is a rear elevation of the training bolt.

Referring now to FIG. 1, there is shown an isometric view of a replacement training bolt carrier group 10, which includes a training bolt 12, a bungee 14 and a flag 16. The operable bolt, referred to herein as a "live bolt," of a firearm is removed from the weapon and replaced with the training bolt carrier group of the invention, with the bungee extending through the barrel of the weapon 17 and flag 16 attached to the free end of the bungee, also referred to herein as an elastic member. Bungee 14 and flag 16 perform two functions: first, the presence of the flag signifies that the weapon is inoperable, and second, bungee 14 provides tension on training bolt 12 so that, when the weapon is "cocked," the training bolt moves rearward and is then urged forward, simulating the motion of a live bolt. To this end, the bungee may be drawn though flag 16, though a central bore 16*a*, and fixed in a position providing proper tension on the training bolt by training the bungee through any of the peripheral notches 16*b* formed in flag 16.

Referring now to FIGS. 2-7, training bolt 12 of the invention is shaped to conform to the bolt receiver of the specific firearm for which it is intended. In the example shown, the training bolt, for use in an AR15/M16 weapon, has a generally cylindrical shape along a majority of its length 18, best seen in FIGS. 3-7, terminating in a tapered nose 20 to facilitate "chambering" in the weapon chamber, from which bungee 16 extends. A number of reliefs are provided about the training bolt to facilitate acceptance of the bolt within the weapon's bolt receiver. In the example, a relief 22 is provided on the top of the training bolt to allow the rifle's hammer to fall when the trigger is pulled; and a relief 24 is provided at the right side of the training bolt to activate the dust cover of an AR-15 or M16. A truncated protrusion 26 is provided in place of the conventional bolt gas key, which allows interface between the training bolt and the rifle charging handle. A hammer cocking ramp 28 is provided on the lower surface of the training bolt and a cutout 30 is provided to clear a buffer spring retaining pin.

Variations of the training bolt are numerous, as the training bolt of the invention may be fabricated to work with any automatic or semi-automatic firearm. The important features, present regardless of the firearm make and model, are the provision of a bolt which is receivable in the bolt receiver of the firearm, provision of cutouts or protrusions which cooperate with the firearm bolt receiver and which allow function of the hammer/trigger/safety mechanism 32 of the firearm, provision of an elastic instrumentality to provide simulated operation of the training bolt when required, provision of appropriate indicia to alert a user that the firearm is equipped with a non-operable, training bolt carrier group, and, most critically, provision of a training bolt which is configured to prevent, absolutely, chambering or firing a live round.

The training bolt provides safer weapons training at a lower cost than existing inert training weapons. The training bolt is incapable of feeding, chambering, firing or ejecting live ammunition, while replacing the conventional, operable bolt in an otherwise functional rifle. Thus, a convention firearm, with the training bolt earner group installed, is converted to a safe training weapon, usable in demonstrations, exhibitions, dry fire, force-on-force, and other training where live-fire is neither desired nor needed.

Another benefit provided by the training bolt carrier group of the invention, over use of specifically inert simulated weapons, is the ability for a user to be familiarized with the "real" firearm, to be able to use the features of the weapon in the exact same configuration with the same stock, weight and balance, sights, optics, grips, sling, and light. This allows for much more realistic training over using a simulated weapon, which typically lacks the working features of the actual weapon. The training bolt carrier group also allows dry fire to be performed with no damage to the firearm.

Thus, a training bolt for a firearm has been disclosed. It will be appreciated that further variations and modifications thereof may be made within the scope of the invention as defined in the appended claims.

I claim:

1. A training bolt carrier group for use in an automatic or semi-automatic firearm, which firearm is capable of firing live ammunition and includes a bolt receiver having a predefined configuration; a hammer/trigger/safety mechanism comprising a hammer, a trigger and a safety; and a barrel extending from said bolt receiver and terminating in a muzzle; comprising:

a training bolt installable in a bolt receiver of a firearm, wherein the training bolt is constructed and arranged with cutouts and protrusions which cooperate with the predefined configuration of the internal structure of the firearm bolt receiver and which allow function of the hammer/trigger/safety mechanism of the firearm, wherein the training bolt is configured to prevent, absolutely, chambering or firing a live round; and an elastic instrumentality, having one end thereof attached to said training bolt and another end thereof extending through said barrel and out said muzzle, to provide simulated operation of the training bolt.

2. The training bolt carrier group of claim 1 which includes appropriate indicia attached to said elastic instrumentality other end to alert a user that the firearm is equipped with a non-operable, training bolt.

* * * * *